US005889875A

United States Patent [19]

Caron et al.

[11] Patent Number: 5,889,875

[45] Date of Patent: Mar. 30, 1999

[54] ELECTROACOUSTICAL TRANSDUCING

[75] Inventors: Gerald F. Caron, Andover; Finn A. Arnold, Sutton; Donald F. Hamilton, Sterling, all of Mass.

[73] Assignee: Bose Corporation, Framingham, Mass.

[21] Appl. No.: 269,662

[22] Filed: Jul. 1, 1994

[51] Int. Cl.[6] ..... H04R 25/00

[52] U.S. Cl. ..... 381/338; 381/300; 381/335; 381/345

[58] Field of Search ..... 381/154, 24, 159, 381/71, 1, 90, 71.4, 77, 300, 335, 338, 345, 353

[56] References Cited

U.S. PATENT DOCUMENTS

| | | | |
|---|---|---|---|
| 3,816,672 | 6/1974 | Gefvert et al. . | |
| 4,075,438 | 2/1978 | Kappel . | |
| 4,549,631 | 10/1985 | Bose . | |
| 4,628,528 | 12/1986 | Bose et al. . | |
| 4,641,345 | 2/1987 | Takahashi | 381/86 |
| 4,868,888 | 9/1989 | Dayton . | |
| 4,932,060 | 6/1990 | Schreiber . | |
| 5,109,416 | 4/1992 | Croft | 381/24 |

FOREIGN PATENT DOCUMENTS

| | | | |
|---|---|---|---|
| 82 17243 | 4/1984 | France . | |
| 0105386 | 4/1994 | Japan | 381/154 |
| 0217387 | 8/1994 | Japan | 381/159 |
| 94/02935 | 2/1994 | WIPO . | |

*Primary Examiner*—Paul Loomis
*Assistant Examiner*—Duc Nguyen
*Attorney, Agent, or Firm*—Fish & Richardson PC

[57] ABSTRACT

Electroacoustical apparatus includes according to one aspect structure for providing a sound field concentrated at a restricted listening region corresponding substantially to a human head while being spaced from the restricted listening region. According to another aspect an electroacoustical transducer is located at the interface of an acoustic waveguide and a ported enclosure.

33 Claims, 3 Drawing Sheets

ELECTROACOUSTICAL TRANSDUCING

The present invention relates in general to electroacoustical transducing and in one form more particularly concerns a novel personal electroacoustical transducing system for providing a sound field concentrated at the location of a single listener and significantly attenuated outside the field of concentration.

A typical prior art approach for providing sound signals to an individual uses headphones. Dayton U.S. Pat. No. 4,868,888 describes a chair that carries a horn speaker behind the back to provide a sound field that extends upwardly from the back of the chair toward the ears of a person sitting in the chair and does not extend horizontally in order to avoid disturbing others in the environment. French Patent No. 82 17243 describes mounting speakers on a table and directing the speakers toward a listener sitting at the table.

In one aspect, the invention features, in general, an electroacoustical transducing system that creates a sound field for a single listener without contacting the listener. The system includes electroacoustical transducer structure supported at a distance from a listening region of size corresponding substantially to that of a human head by a distance less than the order of an arm length of a human being. The electroacoustical transducer structure is constructed and arranged to concentrate its sound field in the restricted listening region, thereby providing sound for the listener while reducing sound outside of the restricted region. Because the system does not touch the listener's head, there are no hygienic concerns in multiuser applications. The listener also does not experience the discomfort, physical isolation, or cosmetic disturbance that might be caused by headphones.

Preferably there are left and right electroacoustical transducers supported so as to face left and right ears, respectively, of a listener whose head is within the restricted region. There can be a third electroacoustical transducer associated with and coacting with enclosing structure to provide bass spectral components in the bass frequency range below a predetermined bass frequency, such as 300 Hz.

According to one aspect of the invention, the enclosing structure includes an acoustic waveguide embodying the principles in U.S. Pat. No. 4,628,528, which is incorporated herein by reference. According to another aspect of the invention, the enclosing structure comprises a multi=chambered enclosure embodying the principles in U.S. Pat. No. 4,549,631 or U.S. Pat. No. 4,932,060, which also are incorporated by reference herein. According to still another aspect, the invention comprises an electroacoustic transducer between an acoustic waveguide and a ported enclosure.

According to a specific aspect of the invention, the acoustic waveguide enclosing structure includes left and right arms having the third electroacoustical transducer at an input end of each arm and the left and right electroacoustical transducers at the output end of each arm. Typically the left and right acoustical transducers, furnishing radiation in the upper frequency range typically above 300 Hz typically extending to 12 kHz, have a dipole radiation pattern with a maximum directed toward the listening region that embraces the near field of the left and right electroacoustical transducers. This causes an ambient sound field at a relatively short distance away from the listening region below a threshold listening level.

Numerous other features, objects and advantages of the invention will become apparent from the following detailed description and from the claims.

Figure 1:
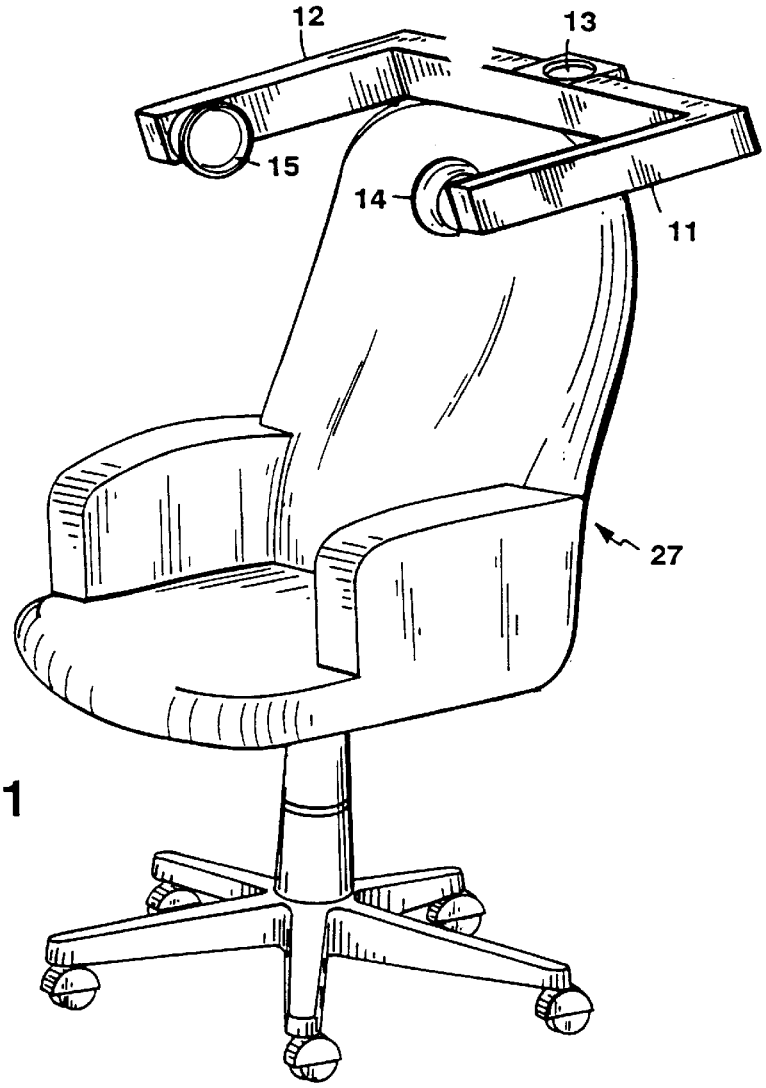
FIG. 1 is a perspective view of an embodiment of the invention having acoustic waveguides shown mounted on a chair.
Figure 2:
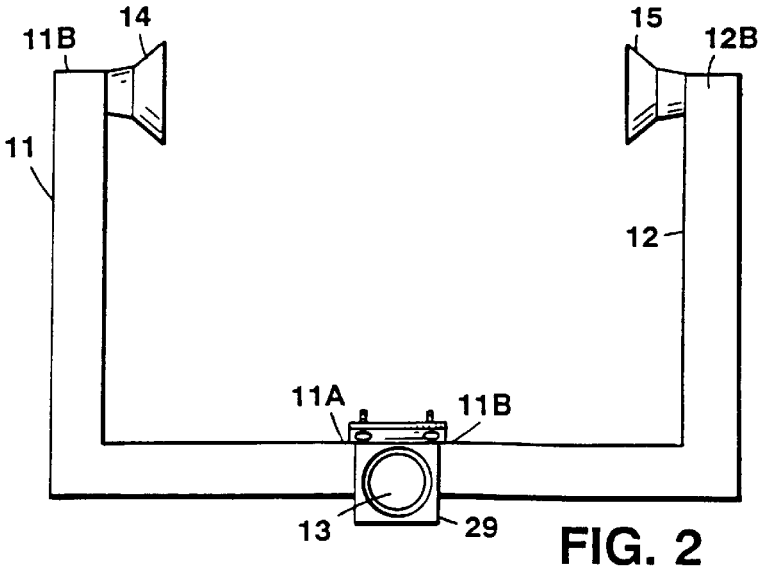
FIG. 2 is a plan view of the embodiment of FIG. 1.

With reference now to the drawings, and more particularly FIGS. 1 and 2 thereof, there is shown a perspective view of an embodiment of the invention having left and right acoustic waveguides 11 and 12 energized at input ends 11A and 12A, respectively, by bass driver 13 and supporting left upper frequency driver 14 and right upper frequency driver 15 at output ends 11B and 12B, respectively. The front surface of the cone of driver 13 partially bounds a chamber communicating with the input ends 11A, and 12A of waveguide arms 11 and 12.

Referring to FIG. 2, there is shown a plan view of the embodiment of FIG. 1. Drivers 14 and 15 are shown aimed directly at each other, which is acceptable when there is little likelihood that the listener will move his head very far from the midpoint between the two drivers. In applications where this is more likely, the two drivers should be somewhat in front of the listener's head and aimed at a point directly in front of the listener's head. In this case, as the listener tends to move to one side, the increase in loudness owing to being closer to the driver on that side is offset by being more on axis for the speaker on the other side.

Figure 3:
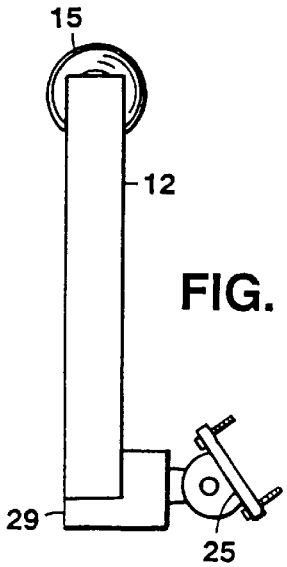
FIG. 3 is a side view of the embodiment of FIG. 1.

Left and right acoustic waveguide arms 11 and 12 are supported by hinged bracket 25 (shown in FIG. 3) so as to allow adjustable positioning by the user and move together as mirror-imaged pair about the medium plane of the listener's head. Bracket 25 is bolted or screwed into the back of chair 27. Because the arms are supported on chair 27, they automatically move with and follow the movements of the listener when rocking in chair 27. The arms could also be mounted for movement toward and away from the listening region and provided with gears so that movement of one arm with respect to the listening region causes a corresponding mirror-imaged movement of the other arm.

Left and right upper frequency drivers 14 and 15 typically comprise a magnetically shielded 3" driver coacting with a baffle described below to produce a focused radiation pattern across the upper frequency range of 300 Hz to 12 kHz. They typically weigh 0.33 pound, and have a nominal impedance of 8 ohms, a low frequency resonance of substantially 190 Hz, and a maximum sound pressure level of at least 82 dB at 1 meter with 1 Watt input, and a rated power of at least 2 Watts IEC with a maximum rating of at least 3 Watts when measured unequalized and unbaffled.

The acoustic waveguide arms are each typically a quarter wavelength long at substantially 85 Hz and are equalized to provide a usable frequency response from 85 Hz to 300 Hz, the total length of each waveguide typically being about 39" with about 30" extending from box 29. The remainder of each tube is within a region in box 29 that is partially bounded by the rear surface of the cone of bass driver 13. The total cross-sectional area of the two waveguides combined typically is 1.57 square inches. Each acoustic waveguide arm output end 11B, 12B, is formed with a port near the attachment point of left and right drivers 14 and 15, respectively, to align the source of bass energy substantially coincident with upper frequency energy.

Bass driver 13 is typically a shielded 2.25" driver substantially the same as that used in the commercially available BOSE WAVE radio. It has a rated impedance of 3.5 ohms and an efficiency, β (the ratio of mechanical force production to the thermal loss incurred while producing that force, as defined, for example, in U.S. Pat. No. 5,216,723) of 2.8 $N^2/W$. Its mean sound pressure level equals 80 dB for 1 Watt input at 1 meter. Its free air resonance is 115 Hz, and its weight is 0.57 pound. Bass driver 13 is preferably open to the free air far from the listener to reduce acoustic interaction with the waveguide output while transmitting negligible far field bass energy from this free air output, thereby helping to keep sound energy outside the listening region at a very low level. The rear surface of bass driver 13 could be exposed to an opening in a different surface than the surface shown in the figures.

Figure 4:
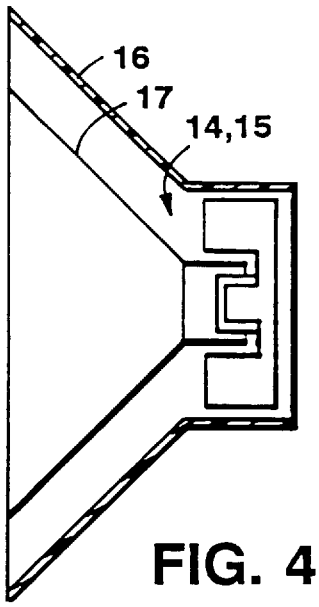
FIG. 4 is a diagrammatic diametrical sectional view of an upper frequency electroacoustical transducer employing a baffle.

Referring to FIG. 4, there is shown a diagrammatic diametrical sectional view of an upper frequency driver-baffle structure helpful in understanding how radiation in the upper frequency range outside the listening region is reduced. Baffle 16 is shown parallel to and outside cone 17 of driver 14 or 15. Cone-shaped baffle 16 forces energy from the rear side of cone 17 to travel the same distance as the energy from the front side, thereby cancelling out the energy from the rear side. Also, acoustically absorptive material can be placed between the driver and the baffle to help to improve performance by equalizing pressure between the front and back of the cone.

Upper frequency drivers 14 and 15 assure that the ambient sound field has a pressure level well below listener's level. In addition, the use of baffle 16 provides a cardioid-shaped sound field, with the primary sound in front and aimed toward the listener to focus the sound at the ears and a minor amount of sound directed to the rear. A concentrated sound field is provided by both the directional nature of drivers 14, 15 and the close proximity (in this case quite a bit less than an arm's length) of the drivers to the listener, with sound being much less outside of the restricted region. The use of waveguides for low frequencies furnish good bass with relatively compact structure.

Preferably the electronics used to provide signals for the transducers employ active equalization, dynamic equalization, compression/expansion, and listener accessible (e.g., on a waveguide 11 or 12) volume and tone controls. An active equalizer incorporated in each channel improves response for near field listening. Dynamic equalization circuitry furnishes good perceived bass response at low listening levels by automatically adjusting system frequency response based on volume setting embodying the principles of Bose U.S. Pat. No. 4,490,843 incorporated herein by reference. Compression/expansion avoids overpowering the system and reduces the dynamic range so that disturbance of others is avoided at peak signal points, and low signal points are not masked from the listener by ambient noise.

The user can listen at low to moderate levels without disturbing others nearby. The user can listen at loud levels without disturbing others in adjacent rooms.

The invention can be used in a wide range of applications to provide a sound field concentrated at the location of a single listener and significantly attenuated outside the field of concentration, e.g., office chairs like chair 27, dentist and beauty parlor chairs, train seats, kiosks, video display terminals, computer, desks, lamps, workstations, arcade games, and automatic teller machines, to name a few.

Figure 2A:
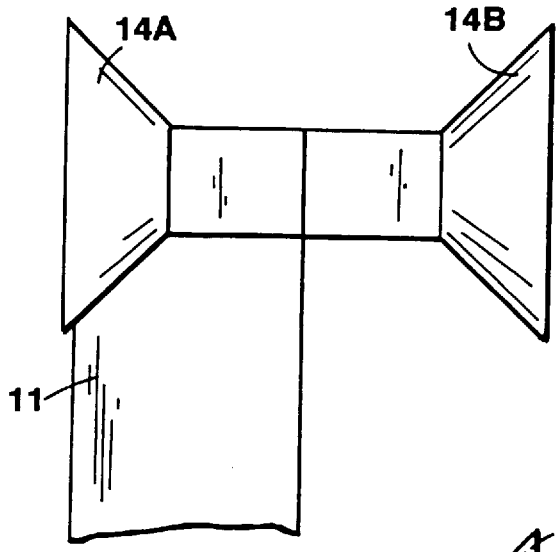
FIG. 2A is a fragmentary plan view of a modification of the embodiment of FIG. 2 showing a dipole speaker formed by first and second electroacoustical transducers mounted back-to-back and operated 180 degrees out of phase with each other.

Other configurations could be used for upper frequency drivers 14, 15. E.g., a concentrated sound field could be provided without the use of a baffle. A dipole speaker could be obtained by using a transducer that is either exposed or enclosed within a wire scrim or other acoustically transparent structure; a dipole speaker has concentrated sound along an axis in front of and in back of an electroacoustical transducer at low frequencies, and sound along the axis in the front only at higher frequencies. A dipole speaker could also be provided by having first and second electroacoustical transducers 14A and 14B mounted back-to-back and operated 180 degrees out of phase with each other as shown in FIG. 2A.

A speaker with a cardioid-shaped field could be obtained by two drivers in a tube. The phases would be slightly out of phase by an amount determined by the distance between the speakers so that the sound output would be in phase along an axis and out of phase (and thus lower in amplitude) off of the axis.

The waveguide arms could be made flexible to permit further positioning by the user; in this case an adjustable arm support system (e.g., like the spring-loaded arms used for desk lamps) could be used to support the upper frequency drivers.

A single waveguide arm could be used; e.g., in an arcade game a single tube with an output end positioned near the listener's head could be connected to an enclosure containing a bass driver.

The system could be supported by other furniture or other structure that is fixed with respect to a region that will be occupied by a user's head when listening.

Also, instead of the large opening on box 29, box 29 could define a ported chamber that is partially bounded by the rear surface of the cone of driver 13 and has a port tuned to a low frequency, according to the principles described in U.S. Pat. No. 4,549,631. In this case, the front of driver 13 would not be ported (as described in U.S. Pat. No. 4,549,631) but would still communicate with waveguides 11, 12. Waveguides 11, 12 could also be used on one side of the driver, at the same time that a sealed chamber is used on the other side of the driver.

Alternatively, waveguides 11 and 12 and box 29 could be replaced by a multichambered enclosure as described in U.S. Pat. Nos. 4,549,631 and U.S. Pat. No. 4,932,060. Such a multichambered enclosure would have chambers on each side of a driver and ports in each chamber. Another variation for low frequencies involves an enclosure having a single ported chamber. In both cases the arms supporting left upper frequency driver 14 and right upper frequency driver 15 would not need to be hollow, and other supporting structure could be used instead of arms. A sealed enclosure could also be used.

The waveguide arms could be aligned so as to be 180° out of phase. One way to do this is for one arm to communicate with the front of the speaker and one to communicate with the back, both having the same length and area. (Another way is for the waveguides to have different lengths so as to be 180° out of phase.) The end of one tube is in close proximity to the listener. The outputs from the two ends would tend to cancel each other for all people except the listener, who would substantially hear only the output from the nearby end, and not be affected by the other output.

In some cases both low and high frequencies can be provided by a pair of directional drivers in close proximity to and directed toward the listener's head, or a point slightly in front of the listener's head, as mentioned above.

Where the drivers cannot be located sufficiently close to a well-defined region for the user's head (e.g., when supported on a computer terminal), it is generally desirable to use smaller drivers, and make separate provision for low frequencies.

Figure 2B:
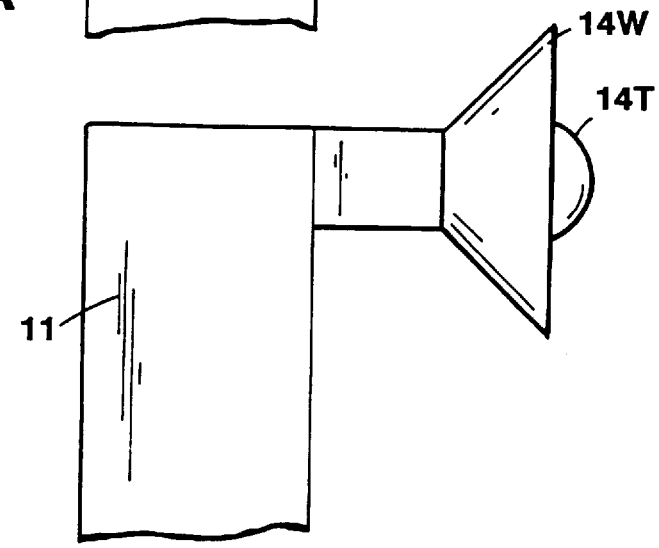
FIG. 2B is a fragmentary plan view of a modification of the embodiment of FIG. 2 including a coaxial tweeter.

In kiosks and other applications where the listener's heads may be at different heights or otherwise located at different positions within in an elongated region, a plurality of electroacoustical transducers can be used. E.g., two or more transducers can be arranged in a horizontal row so as to cause a vertically oriented elongated field. Alternatively, an omnidirectional tweeter 14T that is coaxially positioned in front of a dipole woofer 14W can be utilized to provide a consistent frequency response over a vertical range in the focused listening region as shown in FIG. 2B.

Figure 5:
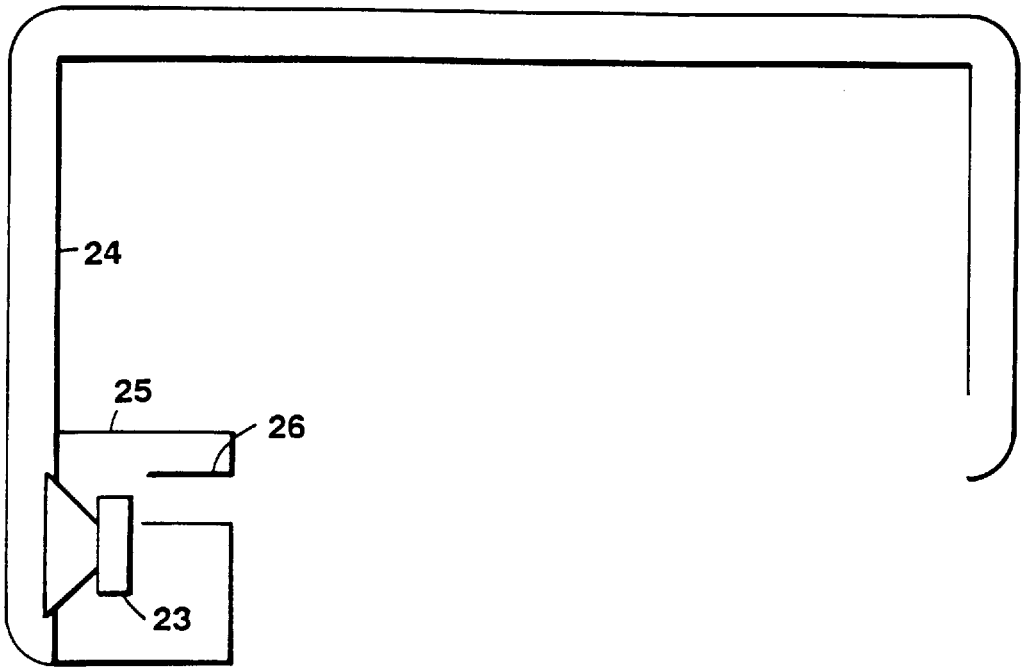
FIG. 5 is a diagram of another embodiment.

Referring to FIG. 5, there is shown a diagrammatic representation of an embodiment of the invention comprising a bass driver 23 between an input end of an acoustic waveguide 24 and a ported enclosure 25 having a port 26. Typically the mass of port 26 and compliance of enclosure 25 establish a mass-compliance resonance at a frequency three times the fundamental resonance of waveguide 24, corresponding to the frequency where waveguide 24 is a quarter wavelength. For example when waveguide 24 is about 2.5 meters long and has a fundamental resonance of about 35 Hz, the mass-compliance resonance of enclosure 25 and port 26 is about 105 Hz. This arrangement helps provide a more uniform power response over the bass frequency range.

Other embodiments are within the claims.

What is claimed is:

1. Apparatus for providing a sound field concentrated at a restricted listening region corresponding substantially to that of a human head, comprising support structure positioned with respect to and spaced from said restricted listening region, and first electroacoustical transducer structure mounted on said support structure, positioned with respect to and spaced from said restricted listening region by a distance less than the order of an arm length of a human being, and being constructed and arranged to provide a concentrated sound field output in said restricted listening region with reduced sound outside of the restricted region, said first electroacoustical transducer structure producing a radiating pattern that is directional across its entire operating range with a maximum directed toward said restricted listening region, said listening region being in the near field of said first electroacoustical transducer structure.

2. The apparatus of claim 1 wherein said first electroacoustical transducer structure includes a first electroacoustical transducer mounted on said support structure and a first sound concentrating structure mounted on said support structure with respect to said first electroacoustical transducer so as to provide said concentrated sound field in said restricted listening region.

3. The apparatus of claim 1 wherein said first electroacoustical transducer structure includes a first electrical transducer that is not enclosed so as to result in a dipole speaker.

4. The apparatus of claim 1 wherein said first electroacoustical transducer structure includes first and second electroacoustical transducers mounted back-to-back and operated 180 degrees out of phase with each other so as to result in a dipole speaker.

5. The apparatus of claim 1 further comprising a second electroacoustical transducer structure mounted on said support structure, positioned with respect to said restricted listening region by a distance less than the order of an arm length of a human being, and being constructed and arranged to provide a concentrated sound field output in said restricted listening region.

6. The apparatus of claim 1 wherein said first electroacoustical transducer structure provides mid and high range frequencies, and further comprising a further electroacoustical transducer mounted on said support structure, and wherein said apparatus has enclosing structure associated and coacting with said further electroacoustical transducer to provide low frequencies below frequencies provided by said first electroacoustical transducer structure.

7. The apparatus of claim 2 further comprising a second electroacoustical transducer mounted on said support structure and positioned with respect to said restricted listening region by a distance less than the order of an arm length of a human being, and a second sound concentrating structure mounted on said support structure with respect to said second electroacoustical transducer to concentrate a sound field generated by said second electroacoustical transducer in said restricted listening region.

8. The apparatus of claim 5 wherein said restricted listening region has a right ear region and a left ear region, and said first electroacoustical transducer faces said right ear region, and said second electroacoustical transducer faces said left ear region.

9. The apparatus of claim 8 wherein said first and second electroacoustical transducers provide mid and high range frequencies, and further comprising a third electroacoustical transducer mounted on said support structure, and wherein said apparatus has enclosing structure associated and coacting with said third electroacoustical transducer to provide low frequencies below frequencies provided by said first and second electroacoustical transducers.

10. The apparatus of claim 9 wherein said enclosing structure comprises an acoustic waveguide.

11. The apparatus of claim 10 wherein said acoustic waveguide comprises first and second arms, said first arm having an input end at said third electroacoustical transducer and an output end at said first electroacoustical transducer, said second arm having an input end at said third electroacoustical transducer and an output end at said second electroacoustical transducers.

12. The apparatus of claim 11 wherein said first and second electroacoustical transducers are supported on respective said first and second arms.

13. The apparatus of claim 9 wherein said enclosing structure comprises a multi-chambered enclosure having ported regions on both sides of said third electroacoustical transducer.

14. The apparatus of claim 2 wherein said first sound concentrating structure comprises a cone-shaped baffle provided behind a cone of said first electroacoustical transducer.

15. The apparatus of claim 8 wherein said first sound concentrating structure comprises a cone-shaped baffle provided behind a cone of said first electroacoustical transducer, and said second sound concentrating structure comprises a cone-shaped baffle provided behind a cone of said second electroacoustical transducer.

16. The apparatus of claim 1 wherein said support structure comprises a chair.

17. The apparatus of claim 1 wherein said support structure comprises a kiosk.

18. The apparatus of claim 1 wherein said support structure comprises a video display terminal.

19. The apparatus of claim 1 wherein said support structure is a member of the group consisting of a computer, a desk, a lamp, a workstation, an arcade game, and an automatic teller machine.

20. The apparatus of claim 8 wherein said first and second electroacoustical transducers are mounted for movement by said support structure as a mirror-imaged unit about a median plane through said restricted listener region.

21. The apparatus of claim 11 wherein said first and second arms and attached electroacoustical transducers are mounted for movement as a mirror imaged unit about a median plane through said restricted listener region.

22. The apparatus of claim 11 wherein said third electroacoustical transducer is mounted in an enclosure, the front side of said third electroacoustical transducer facing a region of said enclosure communicating with said input ends of said first and second arms, the rear side of said third electroacoustical transducer being open to free air outside of said enclosure.

23. The apparatus of claim 11 wherein said third electroacoustical transducer is mounted in an enclosure, the front side of said third electroacoustical transducer facing a region of said enclosure communicating with said input ends of said first and second arms, the rear side of said third electroacoustical transducer facing a region of said enclosure that has a port tuned to a low frequency.

24. The apparatus of claim 11 wherein said third electroacoustical transducer is mounted in an enclosure, the front side of said third electroacoustical transducer facing a region of said enclosure communicating with said input ends of said first and second arms, the rear side of said third electroacoustical transducer facing a sealed region of said enclosure.

25. The apparatus of claim 1 further comprising a low frequency electroacoustical transducer mounted on said support structure, and wherein said apparatus has a multi-chambered enclosure associated and coacting with said low frequency electroacoustical transducer to provide low frequencies below frequencies provided by said first electroacoustical transducer, said multi-chambered enclosure having chamber regions on both sides of said low frequency electroacoustical transducer, said chamber regions having acoustic waveguides associated therewith, said acoustic waveguides comprising first and second arms that provide outputs that are 180° out of phase with each other.

26. The apparatus of claim 25 wherein said first arm has an input end at one said chamber region and an output end near said restricted listening region, said second arm having an input end at the other said chamber region and an output end remote from said restricted listening region.

27. The apparatus of claim 25 wherein said first and second arms have input ends at one said chamber region and different lengths so as to provide outputs that are 180° out of phase with each other.

28. The apparatus of claim 1 further comprising a low frequency electroacoustical transducer mounted on said support structure, and wherein said apparatus has a multi-chambered enclosure associated and coacting with said low frequency electroacoustical transducer to provide low frequencies below frequencies provided by said first electroacoustical transducer, said multi-chambered enclosure having ported regions on both sides of said low frequency electroacoustical transducer.

29. The apparatus of claim 1 wherein said first electroacoustical transducing structure includes a plurality of electroacoustical transducers oriented with respect to each other so as to cause said sound field to be elongated.

30. The apparatus of claim 29 wherein said plurality are arranged horizontally so as to cause said field to be oriented vertically to accommodate listeners of different heights.

31. The apparatus of claim 3 wherein said first electroacoustical transducing structure further includes a coaxial tweeter.

32. Apparatus for providing a sound field at listening region, comprising support structure positioned with respect to said listening region, a first electroacoustical transducer mounted on said support structure, and first sound concentrating structure mounted on said support structure with respect to said first electroacoustical transducer constructed and arranged to concentrate a sound field generated by said first electrical transducer in the listening region with reduced sound outside said listening region, a ported enclosure, a low frequency electroacoustical transducer mounted in said enclosure, the rear side of said low frequency electroacoustical transducer facing a region of said enclosure that has a port tuned to a low frequency, and an acoustic waveguide communicating with a region of said enclosure that is faced by the front side of said low frequency electroacoustical transducer, said waveguide coacting with said low frequency electroacoustical transducer to provide low frequencies below frequencies provided by said first electroacoustical transducer.

33. Apparatus for providing a sound field at a listening region comprising, support structure positioned with respect to said listening region, a first electroacoustical transducer mounted on said support structure, and first sound concentrating structure mounted on said support structure with respect to said first electroacoustical transducer to concentrate a sound field generated by said first electrical transducer in the listening region, a ported enclosure, a low frequency electroacoustical transducer mounted in said enclosure, the rear side of said low frequency electroacoustical transducer facing a region of said enclosure that has a port tuned to a low frequency, and an acoustic waveguide communicating with a region of said enclosure that is faced by the front side of said low frequency electroacoustical transducer, said waveguide coacting with said low frequency electroacoustical transducer to provide low frequencies below frequencies provided by said first electroacoustical transducer, wherein said first electroacoustical transducer is mounted on said support structure at an attachment point, and said acoustic waveguide has an output and is formed with a port near said attachment point.

* * * * *